United States Patent [19]

Tsai

[11] Patent Number: 4,795,143

[45] Date of Patent: Jan. 3, 1989

[54] CIRCULATING MULTI-FORMING CONTINUOUS PRINTING MACHINE

[76] Inventor: Chein M. Tsai, No. 21-1, Lane 58, Chien Mei Road, Hsin Chu City, Taiwan

[21] Appl. No.: 75,894

[22] Filed: Jul. 21, 1987

[51] Int. Cl.[4] ..... B42B 1/02

[52] U.S. Cl. ..... 270/53; 101/50; 270/21.1

[58] Field of Search ..... 270/53, 5, 6, 10–12, 270/18, 21.1; 101/220, 224, 50

[56] References Cited

U.S. PATENT DOCUMENTS

| | | | |
|---|---|---|---|
| 415,321 | 11/1889 | Firm | 270/10 |
| 2,288,149 | 6/1942 | Williams | 270/18 X |
| 2,600,215 | 6/1952 | De Florez | 101/220 |
| 3,329,088 | 7/1967 | Rockefeller, Jr. | 101/220 |
| 3,370,843 | 2/1968 | Woodside | 270/18 |
| 3,883,130 | 5/1975 | Hardesty | 270/21.1 |
| 4,234,178 | 11/1980 | Beckert et al. | 270/12 |
| 4,273,319 | 6/1981 | Stocker | 270/21.1 |

FOREIGN PATENT DOCUMENTS

| | | | |
|---|---|---|---|
| 1235761 | 8/1959 | France | 270/18 |
| 1005531 | 9/1965 | United Kingdom | 270/12 |
| 1275731 | 5/1972 | United Kingdom | 270/12 |

*Primary Examiner*—Eugene H. Eickholt

*Attorney, Agent, or Firm*—Morton J. Rosenberg

[57] ABSTRACT

This invention relates to a circulating multi-forming continuous printing machine and in particular to one including a number of several printing mechanisms with each a belt type printing roller, and being arrayed in a parallel type configuration, and working synchronously, a rolling cutter which is installed behind the printing machine mentioned above and used for cutting paper, one paper feeding table which is next to the rolling cutter, and the surface is a tilting plane which inclines at a certain angle, a number of aluminum sheets being disposed thereon, a plurality of pairs of roller wheels being mounted on opposing sides of each of the aluminum sheets at an appropriate distance, and where one of each pair of roller wheels being larger than the other, a number of collecting plates which are designed to be tilting planes having a slot therethrough, and a number of movable collecting rods which are installed among the collecting plates.

3 Claims, 9 Drawing Sheets

CIRCULATING MULTI-FORMING CONTINUOUS PRINTING MACHINE

DESCRIPTION OF THE PREFERRED EMBODIMENTS

Figure 1:
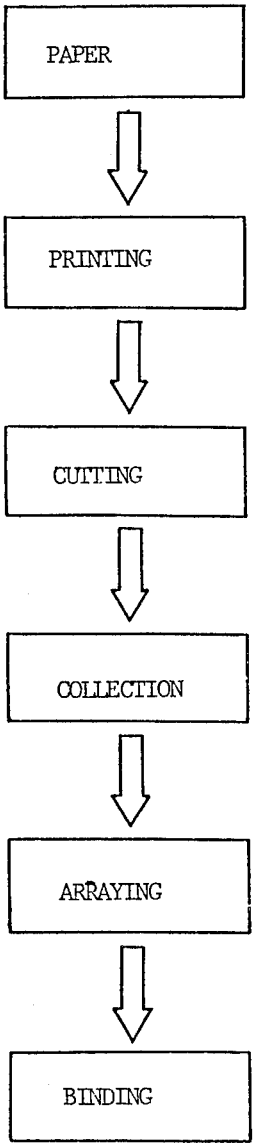
FIG. 1 is the main flow diagram of the present invention.

Referring to FIG. 1, the main flow diagram of the present invention is shown wherein paper is printed by a printing mechanism, and cut by cutting equipment; followed by the collection and collating mechanism in combination with the special array of the present invention, the paper becomes a unit and is ready to be bound into a book.

Figure 2:
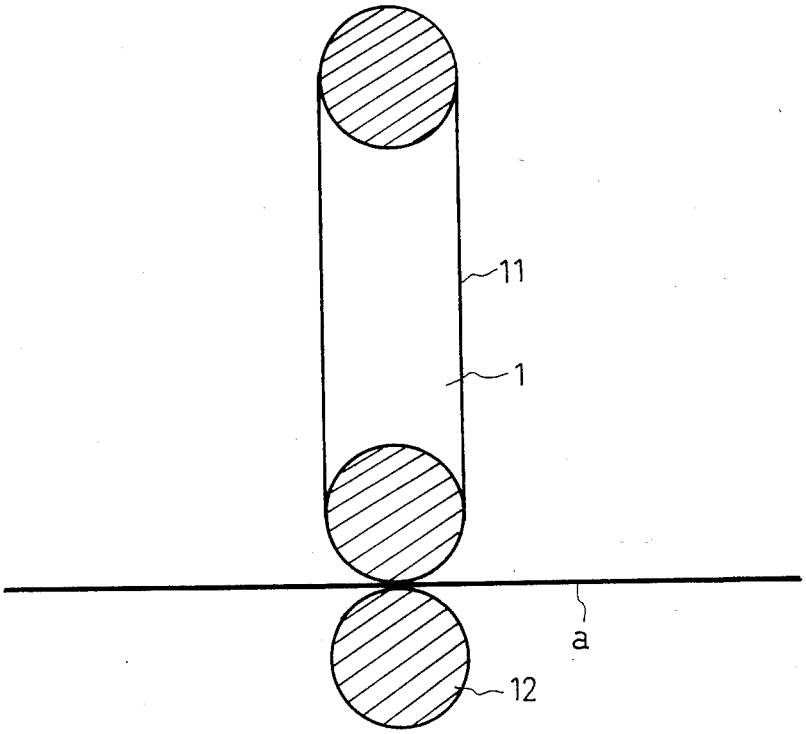
FIG. 2 is a side view of a single printing machine according to the present invention.
Figure 3:
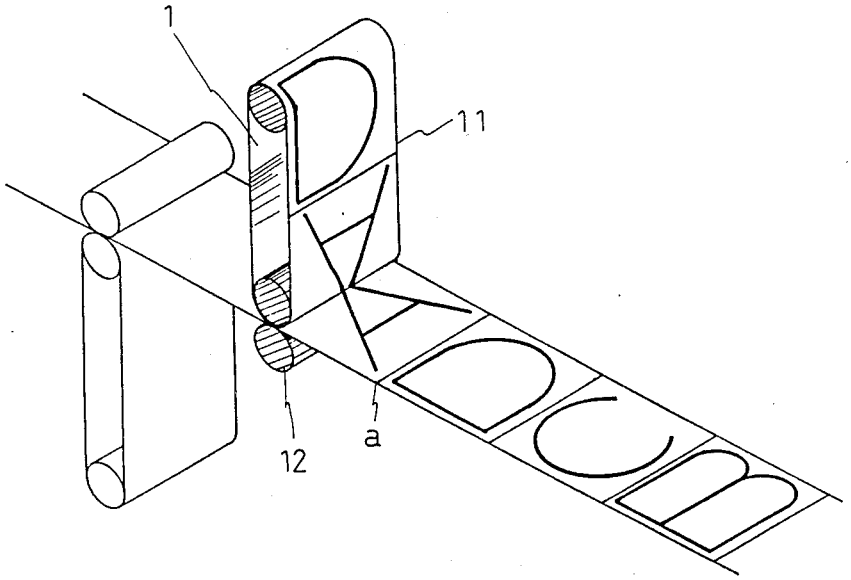
FIG. 3 is a three dimensional view of the single printing machine of the present invention.

In order to understand the operation of the invention better, the illustrations and detailed explanation of "the circulating multi-forming continuous printing machine mechanism" are as follows:

Referring to FIGS. 2 & 3, there are shown respective side and perspective views of the single printing machine of the present invention. The paper (a) is supplied from a continuous roll (not shown in the figures) which can be used to supply a large volume of paper continuously and at a high speed to printing roller 1 and roller 12, thus describing the flow of the paper (a). Printing roller 1 includes a stencil plate located on the belt 11. The roller 12 is provided for supporting and bracing paper (a). When the paper goes under the printing roller 1 of the belt type printing roller, the engraving of the stencil plate on belt 11 provides the printed transfer to paper (a) according to the contents of the publications or books being published, it being adjusted to provide the output represented as A, B, C of FIG. 3 which show printed results of different stencils. Thus, the printing purpose can be met.

Figure 4:
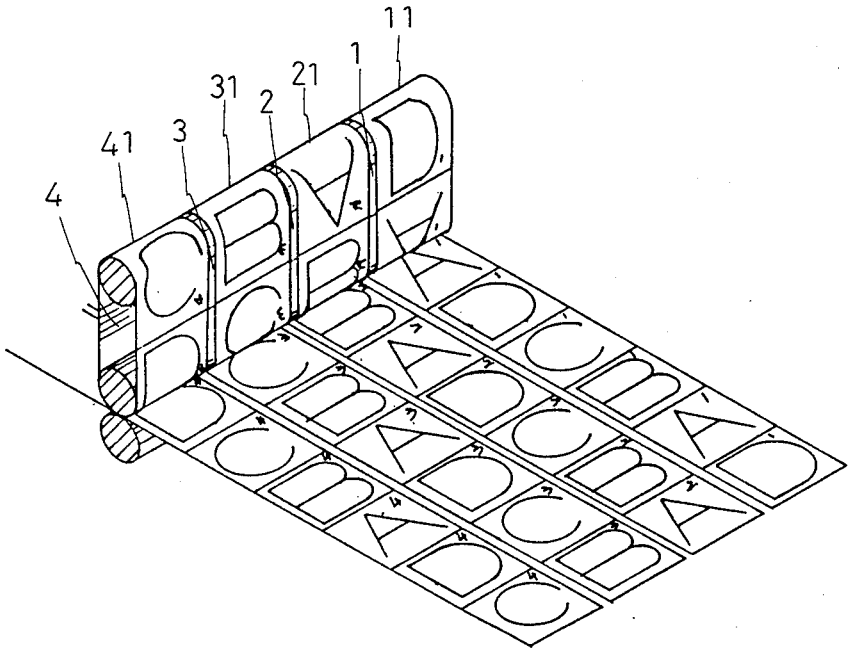
FIG. 4 is an illustration of a number of printing machines according to the present invention operated simultaneously.

As shown in FIG. 4, there is shown the multiple modules of the printing machine and the synchronous operation of the present invention. The belt type printing rollers 1, 2, 3, 4, are of the identical structure and rotate together to synchronously print multiple pages. The belts 11, 21, 31, 41 are equipped with different engravings according to the different contents of the publications and books. In FIG. 4, each of the pages represented by the letters $A^1$, $A^2$, $A_3$, $A^4$ are collected into a unit of a book; the letters $B^1$, $B^2$, $B^3$, $B^4$; $C^1$, $C^2$, $C^3$, $C^4$ and $D^1$, $D^2$, $D^3$, $D^4$ are similarly collected into separate units of a book. They are then ready to bind into book form.

Figure 5:
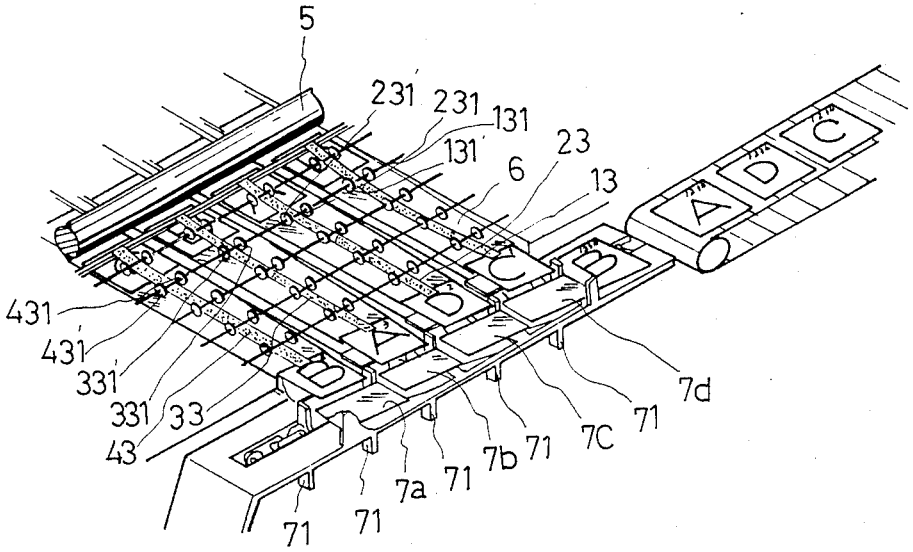
FIG. 5 is an illustration of operation 1 for cutting mechanism and collating mechanism of the present invention.

Referring to FIG. 5, (with reference to FIG. 4), where the modules, operated synchronously, are at the same speed when paper is printed. The paper is subsequently cut into a predetermined size by rolling cutter 5. The length through which that the rolling cutter rotates in one cycle is equal to the length of a printed page. The cut paper moves on the operation surface 6 on which there are provided aluminum sheets 13, 23, 33 and 43 which are strips overlaying the cut pages used to hold each of the respective pages A, B, C and D (shown in the Figure) in position so as not to fly off of surface 6 as they are moved. Rolling wheels 131 & 131'; 231 & 231'; 331 & 331'; and, 431 and 431' are set up at appropriate distances on opposing sides of aluminum sheets 13, 23, 33 and 43, respectively. With the arrangement of those rolling wheels, the cut pages A, B, C, and D are fed quickly to the fixed type collecting plates *7a*, *7b*, *7c* and *7d*. A collecting rod 71, is installed among collecting plates *7a*, *7b*, *7c* and *7d*, so as to make paper on *7a*, *7b*, *7c* and *7d* move smoothly, and sequentially from one plate to next plate in a continuous operation, so that the cut sheets of paper (a) on the collecting plates *7a*, *7b*, *7c* and *7d* are lightly touched and moved to the next collecting plate (for example, the paper on *7a* moves to *7b*).

The above-mentioned collecting plates have an inclined surface through which there is a slot to allow the collecting rod 71 to easily contact the paper located on the collecting plates *7a*, *7b*, *7c*, *7d* and thus move the paper from one collecting plate to the next collecting plate. The design of the paper feeding table 6 has been established to align with those collecting plates; therefore, it is also inclined at the same predetermined angle as the inclined surface of collecting plates *7a*, *7b*, *7c*, and *7d*. The left side of the collecting plates *7a*, *7b*, *7c*, *7d* are higher than the right side. The left side of the feeding table 6 is higher than the right side and it inclines to the right. Thus, the cut sheets of paper (a) can be easily moved to collecting plates *7a*, *7b*, *7c* and *7d*. Furthermore, since the feeding table 6 is slightly inclined at a predetermined angle, the rolling wheels 131, 231, 331, and 431 (located to the right of the aluminum sheets 13, 23, 33 and 43) being on the lower side of the inclined slope of feeding table 6, are designed larger than the left rolling wheels 131', 231', 331' and 431'. They can thereby fully contact respective sheets of paper (a) and provide high speed movement thereof.

Figure 6:
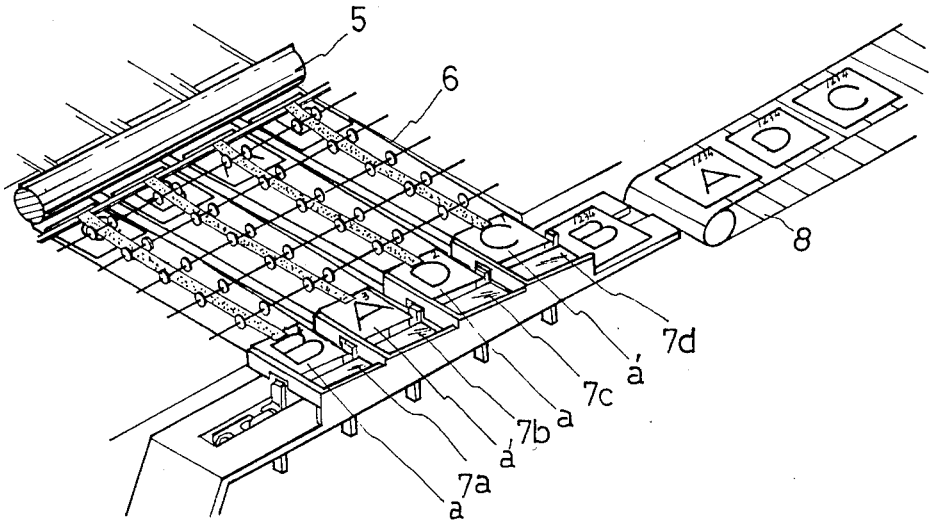
FIG. 6 is an illustration of operation 2 for cutting mechanism and collating mechanism of the present invention.

The operation of cutting, collecting and folding mechanism are shown in FIG. 6. When several of the cut sheets of paper (a) are moved to the collecting plate *7d* by collecting rod 71, it becomes filled. The Figs. illustrate four single printing rollers 1, 2, 3 and 4, therefore one book unit includes four pieces of paper. The collection of one book unit (4 pieces) is finished when the collecting rod 71 moves the cut pieces of paper (a) forward again (the fifth cycle), as the operation is continuous. Hence, the book unit is shifted to the binding department by a carrying belt to complete one cycle of the collating operation.

Figure 7:
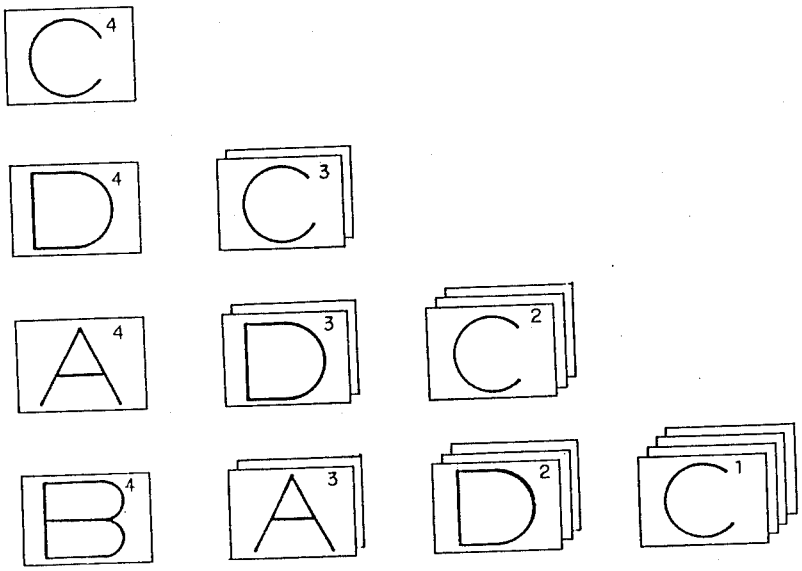
FIGS. 7–9 shows the simplified flow diagram of special sheets collecting method of the present invention.
Figure 8:
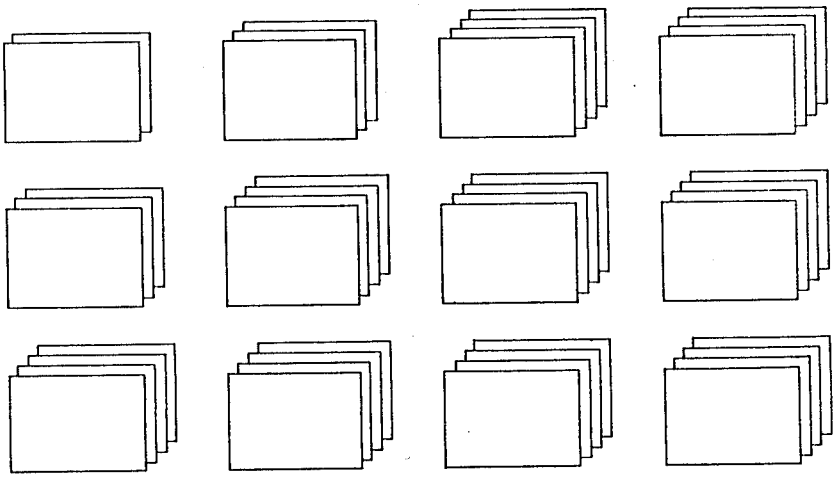
Figure 9:
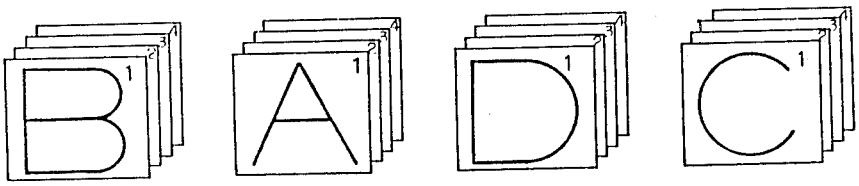

FIGS. 7 through 9 show continuous actions. They are the methods of special printing, arranging, and collecting as provided by the present invention. In the first cycle C (one cycle represents the collecting rod moving one sheet), the accumulation of sheets A, B, C and D is "1" (A, B, D are not shown). C accumulates to become two sheets in the second cycle. As the accumulation continues to the fourth cycle C becomes filled (the example having four printing rollers) and is then ready to be bound into book. After 5th, 6th, 7th, and 8th cycle, the remaining accumulations (A, B and D) become sequentially filled. Thus one unit is ready to be bound after the collecting rod moves once. The continuous sequential operation can thus eliminate manual collating work, and achieve high speed continuous collating of paper.

As stated above, the special collating mechanism of the present invention is to array the engraving sequentially (as shown in FIG. 4) to print out different pages to be bound into one book simultaneously. The number of printing rollers can be increased or decreased according to the required number of pages of a book. The number of collecting plates (*7a*, *7b*, *7c* and *7d*) is also increased or decreased to equal the number of printing rollers. To print on both sides of the paper, the identical printing structure can be set up in front of printing roller 1 and roller 12 with the positions of printing roller 1 and roller 12 exchanged, and thus the other side of paper (a) can be printed. Therefore, "the circulating multiforming continuous printing machine mechanism" can save the human effort involved in paper collecting and paper collating. And it effectively increases the product forming output as well as the product quantity, i.e. within the same time, the traditional printer can print only one book. But, the present invention can print many copies and can form many books (depending on the numbers of printing rollers used).

I claim:

1. A circulating multiforming continuous printing machine mechanism for printing on paper, comprising:

a plurality of printing modules each with a belt type printing roller, and being arrayed in a parallel type configuration, and operating at the same speed to print synchronously on a first surface of said paper;

a rolling cutter for cutting said paper subsequent said synchronous printing;

a paper feeding table adjacent said rolling cutter, said paper feeding table having a surface forming an inclined plane which inclines at a predetermined angle;

a plurality of aluminum sheets being disposed on said inclined feeding table;

a plurality of pairs of roller wheels where each of said pairs is mounted on opposing sides of one of said plurality of aluminum sheets at a predetermined distance along a length dimension of said aluminum sheets, said pairs of roller wheels each having one roller wheel whose diameter is larger than the other;

a plurality of collecting plates being inclined at a predetermined angle to form a plurality of inclined planes, each of said collecting plates having a slot formed therethrough, said collecting plates being inclined at an angle substantially equal to said predetermined angle of said inclined feeding table; and, a plurality of movable collecting rods wherein each extends at least partially through a respective one of said slots in said collecting plates;

whereby said paper goes through said printing rollers of said plurality of printing modules for printing thereon; subsequent to said printing said paper is cut into a multiplicity of independent pieces of paper by said rolling cutter; said independent pieces of paper each being captured on said paper feeding table by one of said aluminum sheets, said pieces of paper being subsequently moved to a respective collecting plate by said plurality of roller wheels; said collecting rod causing the transfer of said pieces of paper from one of said collecting plates to another of said collecting plates sequentially until the last of said collecting plates in said sequence is filled by an accumulation of said pieces of paper equaling a total number of said plurality of collecting plates; said accumulation of said pieces of paper being subsequently moved to a binding operation.

2. The mechanism as recited in claim 1, wherein said array of said printing modules provides an output which is sequentially positionally located in a predetermined manner for providing circulating multi-forming printing.

3. The mechanism as recited in claim 1, wherein at least one of said printing modules having said belt type printing roller positionally located for printing on a second surface of said paper to produce printing on opposing sides of said paper.

* * * * *